United States Patent [19]

Heidan

[11] 4,075,875

[45] Feb. 28, 1978

[54] APPARATUS FOR TREATING WEBS OF TEXTILE GOODS WITH HOT AIR OR STEAM

[76] Inventor: Klaus Heidan, Roonstrasse 84, 415 Krefeld 1, Germany

[21] Appl. No.: 679,079

[22] Filed: Apr. 21, 1976

[30] Foreign Application Priority Data

Apr. 23, 1975 Germany ..... 2517972

[51] Int. Cl.[2] ..... D06B 3/12

[52] U.S. Cl. ..... 68/5 D; 34/157; 34/224

[58] Field of Search ..... 68/5 C, 5 D, 5 E, 20; 34/155, 157, 159, 219, 222, 223, 224; 239/432; 98/33 A, 33 R

[56] References Cited

U.S. PATENT DOCUMENTS

| | | | |
|---|---|---|---|
| 1,296,968 | 3/1919 | Klein | 98/33 A X |
| 1,478,938 | 12/1923 | Case | 34/157 X |
| 1,527,192 | 2/1925 | Judelson | 34/223 X |
| 2,101,301 | 12/1937 | Wellmar | 34/157 X |
| 3,769,817 | 11/1973 | Roach | 68/5 D |

FOREIGN PATENT DOCUMENTS

| | | | |
|---|---|---|---|
| 171,310 | 5/1952 | Austria | 34/159 |

*Primary Examiner*—Philip R. Coe

[57] ABSTRACT

An apparatus for treating in a continuous manner webs of textile goods in a sealed container, especially in a suspended loop damper or steam box with a fresh air or fresh steam supply and with a supply of circulated air or steam. The old air or old steam supply and the fresh air or fresh steam supply together lead into an injector-like slot nozzle which extends nearly over the entire length and width of the container and is located in the upper section of the container. In the injector-like slot nozzle the fresh air or steam is intermixed with old air or steam and passed over the webs of textile goods passed through the container.

4 Claims, 4 Drawing Figures

APPARATUS FOR TREATING WEBS OF TEXTILE GOODS WITH HOT AIR OR STEAM

The present invention relates to a device for treating webs of textile goods with hot air or steam in a sealed container, especially suspended loop damper, with a fresh air or steam supply and a supply of circulated air or steam. In particular, with suspended loop dampers with which the web of textile material suspended in loops is fixed, it must be assured that over the container cross section there will prevail a uniform temperature drop from the upper section of the container downwardly, which means to the lower container section. Furthermore, the air or the steam must circulate in the device.

With a device of the above mentioned type, it is also necessary to maintain a substantially uniform temperature drop from the upper to the lower section of the container and over the entire cross section of the container.

It is, therefore, an object of this invention to provide a device as set forth in the preceding paragraph which will bring about that with circulating air or steam in the container, a uniform air or steam temperature and velocity in the entrance region of the air or steam will prevail regardless of whether old air or old steam, or fresh air or fresh steam is involved.

It is still another object of this invention to provide a device as outlined in the two preceding paragraphs, in which a uniform degree of moisture or uniform steps of mixture of the air or steam will be assured in the container.

These and other objects and advantages of the invention will appear more clearly from the following specification in connection with the accompanying drawings, in which.

Figure 1:
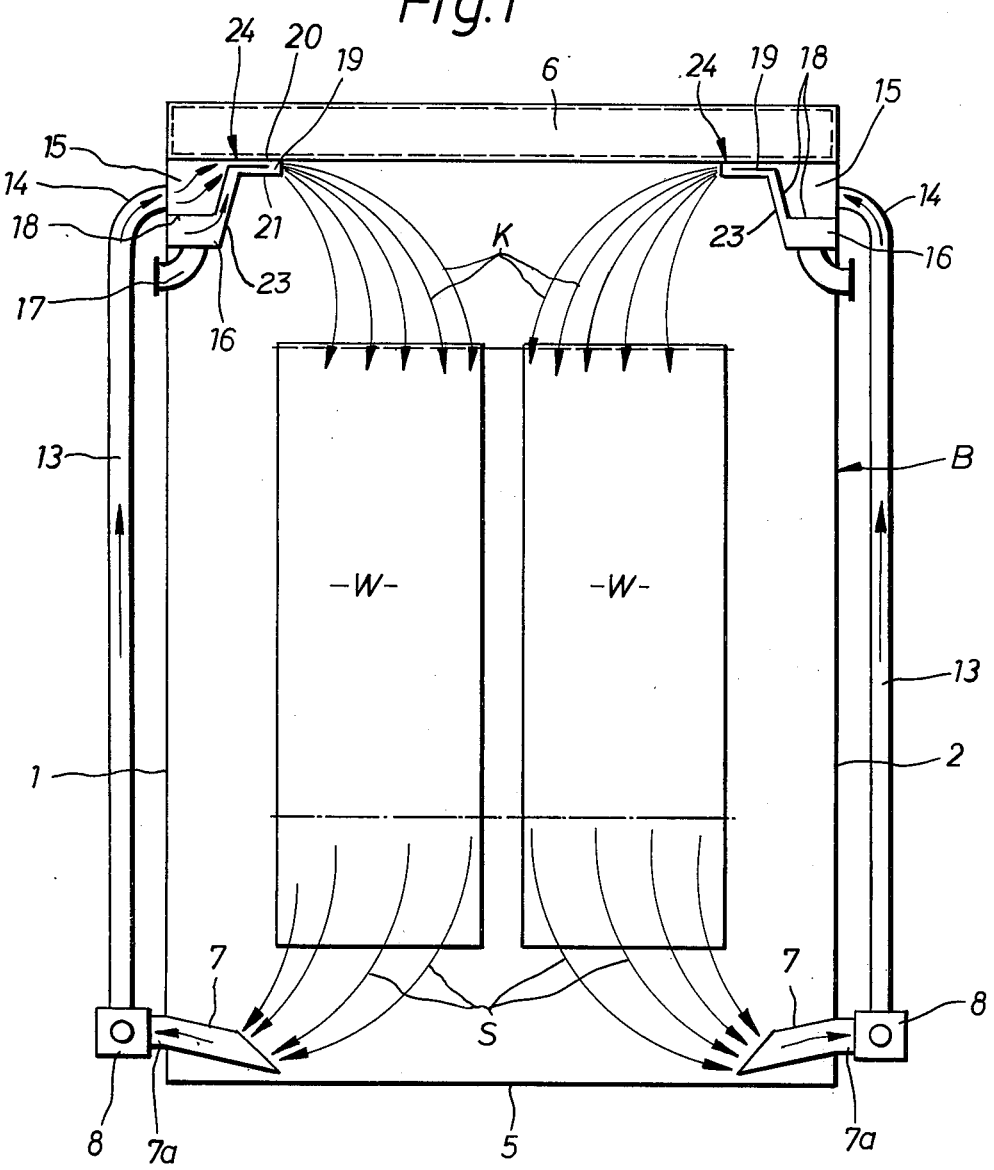
FIG. 1 is a vertical cross section through a device according to the invention.

The device according to the present invention is characterized primarily in that the old air or old steam supply and the fresh air or fresh steam supply to the treatment container together lead into an injection-like nozzle which extends approximately over the length and width of the container in the upper section thereof.

According to a further development of the invention, the fresh air or fresh steam enters the slot nozzle preferably at a higher speed than the old air or old steam.

The invention is based on the finding that a uniform air or steam atmosphere in the container will prevail when the media to be introduced into the container, during their entry into the container are subjected to a thorough intermixing operation so that a uniform medium enters the interior of the container.

According to a still further development of the invention, the old air or old steam passes through transverse flow blowers and flat conduits provided in an accumulating or distributing chamber into the container which chambers merge with the slot nozzle and extend over the length or width or nearly over the length or width of said container.

Advantageously, provided in a parallel arrangement with regard to the accumulating and distributing chamber for the circulated old air or old steam, there is provided an accumulating and distributing chamber for the fresh air or fresh steam, said accumulating and distributing chamber leading into the slot nozzle.

According to the specific design of the slot nozzle as shown in the drawing, the slot nozzle comprises two parallel outer walls and a central wall between the two accumulating and distributing chambers for the circulated old medium and the introduced fresh medium, said central wall merging with the partition of the injector-shaped slot nozzle.

In order to increase the degree of intermixing of the old circulated air or of the old circulated steam on one hand and the fresh air or fresh steam to be introduced on the other hand, it is suggested according to a further development of the present invention to provide the outer walls of the slot nozzle at their inner side in the flow direction of the fresh air or at the level of the free edge of the partition with turbulences or with protrusions bringing about an intermixing of the fresh and old air and fresh and old steam. These protrusions may be such that the two parallel streams of the media cross each other in the slot nozzle and at least partially are subjected to turbulences and change into a partially turbulent flow.

According to a still further development of the invention, the partition in the slot nozzle may be adjustable. In this connection, the partition extending over the length of the slot nozzle may by means of a linkage system extending through the container wall be adjustable from the outside of the container while the partition is pivotally arranged on the intermediate wall between the two accumulating and distributing chambers.

Referring now to the drawings in detail, the container B of the device according to the invention comprises longitudinal walls 1 and 2, end walls 3 and 4, the bottom 5, and the ceiling 6. The ceiling 6 forms a chamber and in its interior has arranged a ceiling heating system known per se. If desired, a medium giving off heat is introduced into the chamber forming ceiling 6.

A plurality of rectilinear suction boxes 7 which are spaced from each other extend through the lower section of the two longitudinal walls 1 and 2. The length of said suction boxes 7 totals approximately the length of the container B. These suction boxes lead with their section *7a* into a plurality of transverse flow blowers 8. The distance of the boxes corresponds to the distance between the transverse flow blowers 8 in the longitudinal direction of the container B.

Between the transverse flow blowers 8 which are arranged on the outside of the container B, there are provided driving means in the form of a shaft and a roller 9, a transmission means 10 which cooperates with a further roller 11 on the shaft of a motor 12. The individual motors 12 are adapted to operate individually but they can also be employed so as to work together. Conduits 13 having a flat rectilinear cross section extend from the transverse flow blowers 8 to the upper section of the container B. These conduits lead through a bent pipe section 14 to an accumulating and distributing chamber 15 which extends approximately over the length of the container B.

Arranged parallelly below said accumulating and distributing chamber 15 there is a further accumulating and distributing chamber 16 which has the same length as the accumulating and distributing chamber 15. The pipe sections 17 lead from fresh air or fresh steam feeding conduits into the said accumulating chamber.

The intermediate wall 18 between the two chambers 15, 16 ends in a partition 19 which is located between the wall 20, forming a partoof the ceiling 6 and a wall 21. The wall 21 ends in the confining wall 23 of the accumulating and distributing chamber 16. The two walls 20 and 21 form a slot nozzle 24 which extends over the length of the two chambers 15, 16 into which the slot nozzle of partition 19 extends in such a way that an injector-like slot nozzle is formed from which the media conveyed to the two chambers 15, 16 pass in the direction of the arrow K into the interior chamber of the container B where they are able to act upon the web of goods W which in a manner known per se is passed in loops through the container.

After the two media mixed in the slot nozzle have passed from the chambers 15, 16 through the container B from above in downward direction, the mixed media pass in the direction of the arrows S into the suction boxes 7 and from here are by means of the transverse blowers 8 conveyed into the chamber 15 as old air or old steam. A portion of the media passing in the direction of the arrows K into the container can be withdrawn through outlets (not illustrated). Fresh air or fresh steam passes through the connections 17 into the chamber 16 and together with the old air or old steam are conveyed through the slot nozzles 24 into the container B. Preferably, the speed of the fresh air or fresh steam is greater than the speed of the old air or old steam in chamber 15 so that the fresh air or the fresh steam represents the driving medium and aids the work of the transverse blowers which have a relatively low $\Delta$ P.

Through the connection 17, fresh air or fresh steam having sufficient moisture is passed in order to prevent the web of goods from drying out.

In order to be able to meet the requirements outlined above, a substantially uniform medium (due to the intermixing of the media in and shortly behind the slot nozzle) is introduced into the inner chamber of container B through the slot nozzle 24 which extends approximately over the length of the device.

Figure 3:
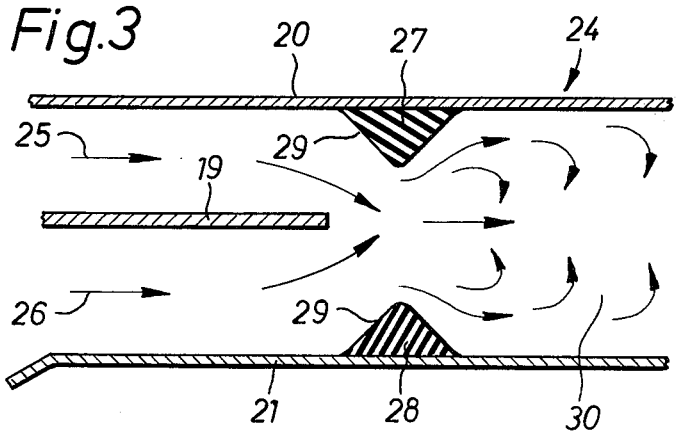
FIG. 3 shows a slot nozzle with inner projections for generating turbulences.
Figure 2:
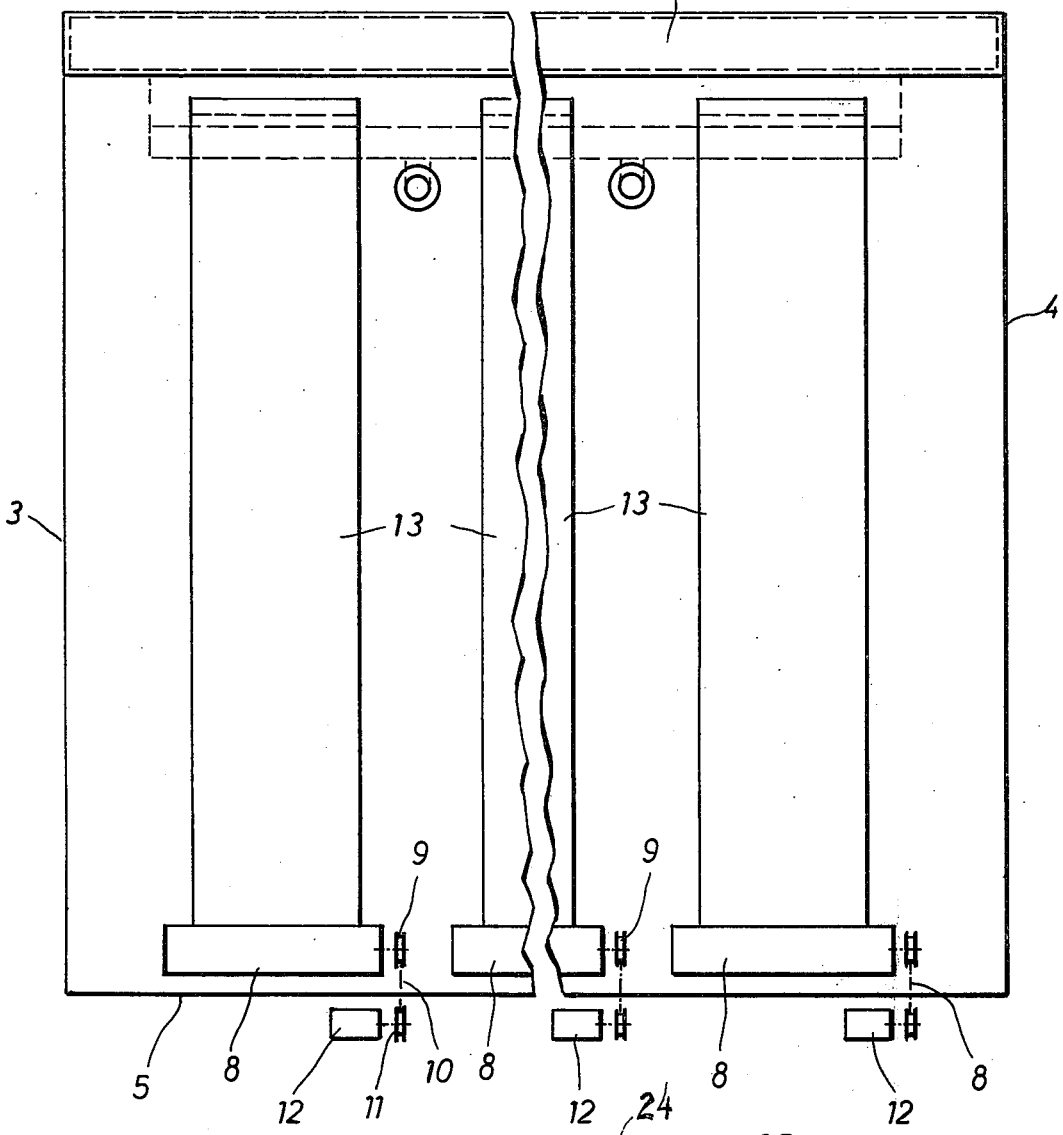
FIG. 2 represents a vertical longitudinal section through the device according to the invention.

According to the embodiment of FIG. 3, the inner sides of the walls 20, 21 are in the direction of the media flowing through the slot nozzle 24 (arrows 25, 26) behind the partition 19 provided with ribs 27, 29. These ribs extend over the length of the slot nozzle, and the introduced media impact upon the section 29 of said slot nozzle in such a way and are deflected so that in the section 30 of the nozzle or therebehind, a turbulence is created and thus an at least partially turbulent flow which aids the intermixing of the media.

Figure 4:
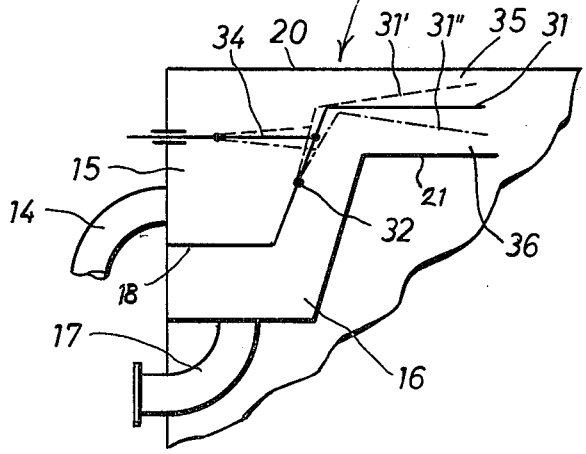
FIG. 4 shows a slot nozzle with an adjustable partition therein.

According to the embodiment of FIG. 4, the partition 31 is designed as an angled element which has one of its edges 32 pivotally arranged so that the partition in addition to being movable into the position shown in solid lines is also movable into the position 31' and 31''. As a result thereof, the exit openings 35, 36 of the two media from the chambers 15, 16 can be varied whereby the ratio of the two media is variable in a simple manner. The pivotable partition 31 can by means of a linkage system 24 be adjusted from the outside of the container.

It is, of course, to be understood that the present invention is, by no means, limited to the specific showing in the drawings, but also comprises any modifications within the scope of the appended claims.

What I claim is:

1. An apparatus for treating in a continuous manner webs of textile goods which includes: a container having an upper portion as well as a major width and length, supporting means arranged in said container for supporting webs of textile material to be treated by a gaseous treating medium, slot-nozzle means arranged in the upper portion of said container and extending at least over the major width and length of said container, said supporting means being provided for the textile material having a first section adjacent said nozzle means and also having a second section remote from said nozzle means, said nozzle means being adapted to receive and release a gaseous treating medium onto said first section for treating a web of materials whenever placed correspondingly on said supporting means, said nozzle means being provided with first inlet means connectable to a supply of a fresh gaseous treating medium and also being provided with second inlet means, and means for withdrawing gaseous treating medium from said second section whenever treating medium is released by said nozzle onto said first section and for conveying said withdrawn gaseous treating medium to said second inlet means, said means for withdrawing gaseous treating medium from said second section including blower means communicating with said nozzle means, said nozzle means having associated therewith and communicating with first accumulating and distributing chamber means for receiving treating medium withdrawn from said second section and also having associated therewith and communicating with said accumulating and distributing chamber means for receiving fresh treating medium from said first inlet means, said nozzle means including two substantially parallel outer walls and a first partition, said first and second accumulating and distributing chamber means being separated from each other by a second partition, said first partition merging with said second partition.

2. An apparatus according to claim 1, which includes means for causing said fresh treating medium to enter said nozzle means at a higher speed than said treating medium withdrawn from said second section.

3. An apparatus according to claim 1, in which said outer walls in the intended flow direction of the fresh treating medium are, in the vicinity of said first partition, provided with projections for creating turbulence for a treating medium passing past said projections.

4. An apparatus according to claim 1, in which said first position in said nozzle means is pivotable so as to vary the cross section of the passages defined by said two outer walls on one hand and said first partition on the other hand.

* * * * *